United States Patent [19]

Kroll et al.

[11] 4,083,326

[45] Apr. 11, 1978

[54] SINGLE COMPONENT DEVELOPER APPLICATOR APPARATUS

[75] Inventors: Arthur Stanley Kroll, Spencerport; Frank Alexander Shuster, Rochester, both of N.Y.

[73] Assignee: Eastman Kodak Company, Rochester, N.Y.

[21] Appl. No.: 772,400

[22] Filed: Feb. 28, 1977

[51] Int. Cl.[2] ..... G03G 15/08

[52] U.S. Cl. ..... 118/661; 118/656; 118/262

[58] Field of Search ..... 118/661, 656, 657, 651, 118/262

[56] References Cited

U.S. PATENT DOCUMENTS

| | | | |
|---|---|---|---|
| 2,892,709 | 6/1959 | Mayer | 118/661 X |
| 2,902,974 | 9/1959 | Greaves | 118/656 |
| 2,987,037 | 6/1961 | Bolton | 118/656 X |
| 3,103,445 | 9/1963 | Bogdonoff et al. | 118/656 X |
| 3,152,012 | 10/1964 | Schaffert | 118/656 |
| 3,405,682 | 10/1968 | King et al. | 118/661 X |
| 3,589,895 | 6/1971 | Ville | 118/657 X |
| 3,592,167 | 7/1971 | Blow, Jr. | 118/656 |
| 3,601,092 | 8/1971 | Satomi | 118/661 |
| 3,654,893 | 4/1972 | Piper et al. | 118/651 X |
| 3,696,783 | 10/1972 | Fantuzzo | 118/652 |
| 3,850,662 | 11/1974 | Jahn | 118/657 |

*Primary Examiner*—Mervin Stein
*Assistant Examiner*—Andrew M. Falik
*Attorney, Agent, or Firm*—John D. Husser

[57] ABSTRACT

A device for applying single component developer includes an electrically conductive fur brush which charges the toner triboelectrically and which serves as a donor roller to a touchdown applicator roller. Electrical metering means control the supply of toner to the applicator and to the image member to be developed to facilitate more uniform image development.

6 Claims, 1 Drawing Figure

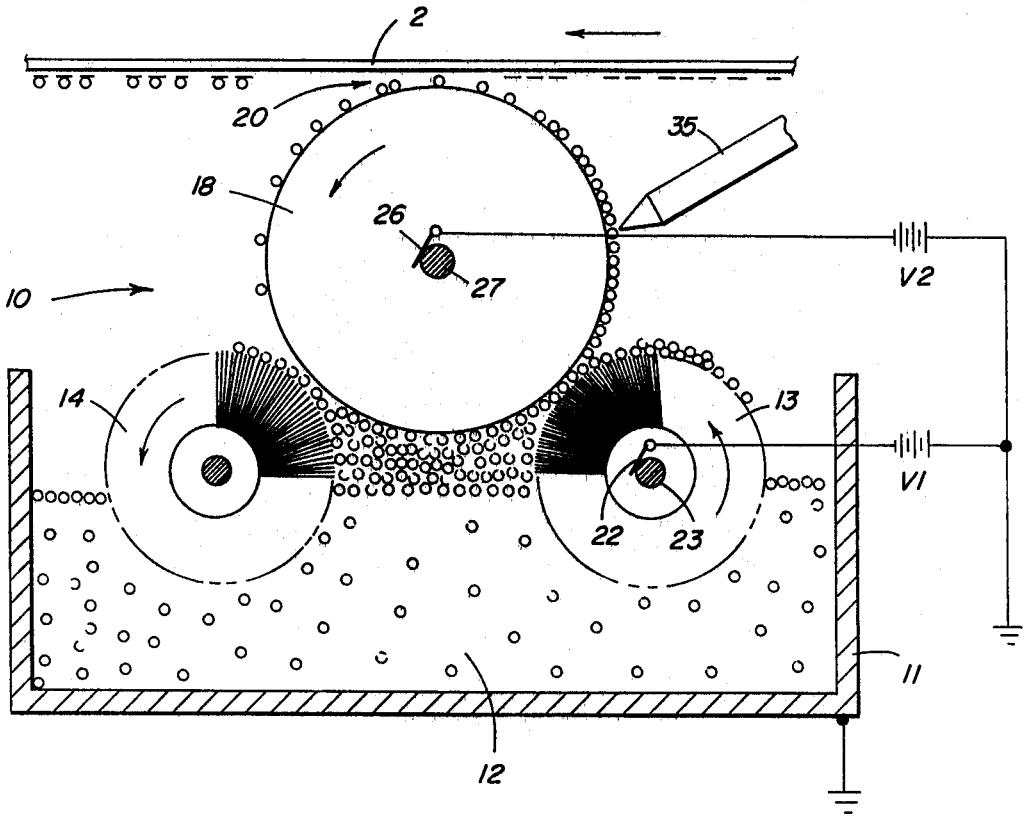
2
20
35
18
26
27
V2
10
14
13
V1
22
23
11
12

SINGLE COMPONENT DEVELOPER APPLICATOR APPARATUS

BACKGROUND OF THE INVENTION

1. Field of the Invention

The present invention relates to improved apparatus for developing latent electrostatic images with marking particles and more particularly to such apparatus of the donor roller type whereby single component developer is adhered to a cylindrical applicator and rotated in non-slip transfer relation with the image member to be developed.

2. Description of the Prior Art

Since the commercialization of electrophotography, numerous different general approaches have been devised for applying marking particles to a latent electrostatic image, i.e., developing the image. Each general approach has been implemented in a great many different devices, illustrating that development continues to present a problem in such copying devices. Cascade and magnetic brush development systems have met with the most commercial success; however, these systems involve two component developer and related problems such as concentration control and carrier particle carry-out on the image member.

Thus continuing attempts have been made to devise single component development systems. Perhaps the most frequently pursued general approach has been fur brush development, in which the bristles of animal fur or synthetic fibers, properly triboelectrically related to toner particles, charge and attract the toner in a reservoir and then apply the attracted toner to the image to be developed. Such brushes have been made partially electrically conductive, e.g., to provide a threshold below which toner will not transfer to background areas of the image. However, there are various problems with fur brush applicators, a substantial one being a difficulty in uniformly loading the brush and the non-uniformity of development which thus results.

Various attempts have therefore been made to develop other single component applicators. An approach pursued by a significant number of implementations has been a "donor roller technique" in which a layer of charged toner particles is adhered by some means to an applicator member that moves into a transfer relation with a moving electrostatic image member at a speed selected to eliminate any relative movement between the roller and the image member at the development zone. The problems which must be dealt with in such an approach are several. Layer thickness must be uniform to achieve uniform development, agglomerates of the toner powder should not be present in the layer and the toner particles should have substantially uniform charge. Additionally, it is very desirable to provide some threshold control to avoid the transfer of particles to background charge areas on the image member.

The present invention pertains to an improved implementation of this latter approach which obviates such difficulties and provides excellent image development.

SUMMARY OF THE INVENTION

It is therefore an object of the present invention to provide improved apparatus for developing electrostatic images.

It is a further objective to provide such apparatus, in a simple and inexpensive construction, which affords means for presenting a layer of single component developer of uniform thickness and charge in a manner that allows control of development quality.

BRIEF DESCRIPTION OF THE DRAWING

The invention is hereinafter described in connection with the attached drawing which forms a part hereof and in which the FIGURE is side view illustrating one embodiment of the present invention.

BRIEF DESCRIPTION OF THE PREFERRED EMBODIMENT

In the FIGURE, an embodiment of development apparatus 10, constructed in accordance with the present invention, is shown in operation developing a latent electrostatic image on an image member 2. The image member can be a charged and imagewise exposed photoconductor or a dielectric member on which an electrostatic image has been transferred or recorded, e.g., with ion printing.

The developing apparatus 10 includes a supply reservoir 11 which is electrically grounded and contains a supply of single component toner particles 12 of a conventional electrically insulative type, i.e., triboelectrically chargeable and capable of retaining such charge.

Mounted for rotation in the reservoir in a spaced, parallel relation, are brush loading members 13 and 14, of a type generally known in the art. For example, useful materials for the loading brushes include natural fibers such as hair, cotton, wool, flax and hemp and synthetic fibers such as rayon, cellulose esters, vinyl polymers, polyester, polyamides, polyurethanes, polyolefins, and glass. At least the last brush member 13 is made partially electrically conductive by application of metal such as nickel, cobalt, gold, copper, palladium or the like. Alternatively, the fibers can be extruded and contain conductive particles such as carbon. The roller bristles are selected with regard to the particular toner used, in a manner known in the art, to be properly triboelectrically related to the toner and create thereon a charge opposite to that of the image to be developed. Another useful brush material is a polyester fiber modified by embedding carbon or similar particles therein. One specific fiber of this type is called an epitropic fiber, and manufactured by I.C.I. Fibers of Yorkshire, England. When woven onto a conductive backing such material acts both as a carrier, providing a triboelectric relationship with the toner and as an electrically attracting electrode. The fibers are soft and would not damage the surface of a contacted member and have good stability in varying humidity conditions. Herein such brush members are referred to generically as "electrically conductive fur brushes". In the illustrative embodiment, the particles bear a positive triboelectric charge and the image to be developed is negative polarity.

Rotatably mounted generally intermediate and above the loading members 13 and 14 is an applicator roller 18 which is formed of conductive material, e.g., aluminum. The applicator roller can be formed of other conductive metals and, if desired, a thin, insulative peripheral overcoat can be provided. As shown, the loading members 13 and 14 and applicator roller 18 are disposed, below the image member 2, so that the upper peripheral surface of the applicator roller 18 passes in contact with the image member at a development zone 20 and the lower peripheral surface of the applicator roller 18 passes in contact with the bristles of the loading members at a supply zone.

The rollers are driven by a conventional motor means, not shown. The applicator roller is rotated in a direction, and at a speed, such that there exists substantially no relative movement between the peripheral surface of roller 18 and the image member 2 in the development zone. Loading members are desirably rotated in a direction such that their peripheral surface portions contacting applicator member 18 are moving in the opposite direction to the contiguous applicator member surface. The surface velocity of the loading members is selected to obtain a good triboelectric interaction and is desirably higher than that of the applicator member 18.

As shown in the FIGURE, an voltage source $V_1$ is coupled to loading members 13 by a conventional electrical brush connection 22 contacting its shaft 23. The voltage $V_1$ can be applied to both of the members 13 and 14, but it is necessary in accordance with the invention that voltage $V_1$ be applied to at least the last loading roller to contact applicator roller surface during its loading motion (member 13 in the embodiment shown) and that the bristles of that member have a substantial contact with applicator surface after its movement out of the toner sump.

Applicator roller 18 is electrically coupled to voltage source $V_2$ similarly by means of brush element 26 contacting its shaft 27. In accordance with an important aspect of the present invention, voltages $V_2$ and $V_1$ are both of the same polarity as the electrostatic image to be developed and of a polarity opposite to the charge of the toner particles. Voltage $V_2$ is of a magnitude greater than voltage $V_1$ to such extent as to facilitate controlled transfer of toner to the applicator; and it is essential for development of the charge areas on the photoconductor that voltage $V_2$ be less than the potential of the image areas to be developed. Desirably, the voltage $V_2$ can be greater in magnitude than any charge on background areas of the image member.

Although the above-described electrical metering of toner provides a generally uniform thickness toner layer on the applicator roller, a skive member 35 can be provided to smooth the toner on the applicator roller, e.g., eliminating any streaks caused by the bristles of the loading rollers 13, and further improving thickness uniformity of the toner layer passing into the development zone.

In operation, the loading rollers rotate with a lower portion in the developer and triboelectrically charge and attract toner. The loading rollers additionally serve to break agglomerates of toner. As the applicator roller surface moves counterclockwise, as viewed in the FIGURE, out of contact with the last contacting loading roller 13, an electrically metered quantity of toner remains on the surface of the applicator roller as a result of the competitive attraction of the rollers for the charged toner. This quantity can be controlled by varying the relative magnitude of voltage $V_2$ to $V_1$. The uniform layer of toner on applicator roller 18 then is smoothed by skive 35 and passes into a contacting transfer relation (substantially zero relative movement) with the image member. The image areas of member 2, being at a higher potential than potential $V_2$, attract the oppositely charged toner particles from the applicator roller layer, while the applicator roller retains the portions of its toner layer which move in transfer relation with non-image areas of the image member.

The following example provides additional illustrative teachings of the practice of the invention.

A 3 inch diameter aluminum roller was used as the applicator roller shown in the FIGURE and two Angor Mohair paint rollers, to which nickel had been applied as described above, were used as loading rollers. A conventional insulative dry toner was used as developer. A voltage of −275 volts was applied to the loading roller and a voltage of −300 applied to the applicator roller. A member bearing imagewise charge areas of approximately −325 volts was moved in contact, and at substantially zero relative velocity, with the loaded applicator roller. Good overall development was obtained, and sharp detail development without edge flaring was observed.

It has been found that higher voltage differentials, e.g., 100 volts, between the applicator and loading rollers can be used. A 50-volt differential has been found adequate for most available toners.

The invention has been described in detail with particular reference to a certain preferred embodiment thereof, but it will be understood that variations and modifications can be effected within the spirit and scope of the invention.

What is claimed is:

1. Improved apparatus for developing an electrostatic image on a moving image member, said apparatus comprising:
   (a) an electrically conductive applicator roller located for movement in developing relation with such image member;
   (b) a toner reservoir located proximate said applicator roller;
   (c) an electrically conductive fur brush located in said reservoir and in contact with said applicator roller, said fur brush being constructed to create an electrostatic charge of a first polarity on toner in the reservoir; and
   (d) bias means coupled to said reservoir, brush and applicator roller for electrically metering the supply of toner from said reservoir to such image member, said bias means including means for applying a first electrical potential of polarity opposite said first polarity on said fur brush, and means for applying to said applicator roller a second electrical potential of the same polarity as, but greater magnitude than, said brush potential, said second potential further being of the same polarity as, but lesser magnitude than, the electrostatic image to be developed.

2. In an electrographic apparatus of the type having means for moving an electrostatic image bearing member past a development station, an improved device for developing electrostatic images, said device comprising:
   (a) a reservoir for containing a supply of triboelectrically chargeable electrographic toner,
   (b) an applicator roller having an electrically conductive central portion and a peripheral developing surface and being rotatably mounted in said apparatus so that said developing surface passes a development zone, contiguous the path of the moving image member, and to a supply zone proximate said reservoir;
   (c) toner supply means comprising at least one cylindrical brush member having bristles triboelectrically related to the toner so as to create an electrostatic charge of a first polarity on contacted toner and being sufficiently electrically conductive to provide an electrically created attractive force on contacted toner particles, said brush member being rotatably mounted within said apparatus and of size and location such that, during rotation, its peripheral surface passes into said toner supply and then into contact with said applicator roller at said supply zone;

(d) first means for rotating said applicator roller so that its peripheral surface passes contiguous image member portions in said development zone with substantially no relative velocity therebetween;

(e) second means for rotating said brush member at a rate sufficient to triboelectrically charge contacted toner; and (f) means for electrically metering toner from said reservoir to the image member, said metering means including means for biasing said brush member at first electrical potential opposite in polarity to said first polarity and means for biasing said applicator roller at a second electrical potential which is of the same polarity as, but greater magnitude than, said first electrical potential and which is of lesser magnitude than the electrostatic image charge to be developed.

3. The invention defined in claim 2 wherein second rotating means rotates said brush member with surface portions thereof which contact said applicator roller moving opposite in direction from the contacted surface of said applicator roller.

4. The invention defined in claim 2 wherein said supply means includes a second brush member constructed to so triboelectrically charge said toner and wherein said second brush member contacts successive portions of said applicator roller surface during entrance to the supply zone and said one brush member thereafter contacts those portions during exit from said supply zone.

5. The invention defined in claim 2 wherein said reservoir is conductive and said first potential is applied between said reservoir and said one brush member.

6. The invention defined in claim 2 wherein the image bearing member has an image charge level and a background charge level and the magnitude of said second electrical potential is intermediate said charge levels.

* * * * *